US009185957B2

(12) United States Patent
Richmond et al.

(10) Patent No.: US 9,185,957 B2
(45) Date of Patent: Nov. 17, 2015

(54) AUTOMATIC HAIR STYLING DEVICE

(71) Applicant: TRADE BOX, LLC, Culver City, CA (US)

(72) Inventors: David Richmond, Culver City, CA (US); Howard Richmond, Los Angeles, CA (US); Michael A. Ragosta, Calabasas, CA (US); Zhiyong Yu, Wenzhou (CN); Zhiwu Yu, Wenzhou (CN); Rentong Wang, Wenzhou (CN); Wenrui Dai, Wenzhou (CN)

(73) Assignee: TRADE BOX, LLC, Culver City, CA (US)

( * ) Notice: Subject to any disclaimer, the term of this patent is extended or adjusted under 35 U.S.C. 154(b) by 0 days.

(21) Appl. No.: 14/304,787

(22) Filed: Jun. 13, 2014

(65) Prior Publication Data

US 2014/0366909 A1 Dec. 18, 2014

Related U.S. Application Data

(60) Provisional application No. 61/835,390, filed on Jun. 14, 2013.

(30) Foreign Application Priority Data

| | | |
|---|---|---|
| Oct. 30, 2013 | (CN) | 2013 1 0523311 |
| Oct. 30, 2013 | (CN) | 2013 2 0675439 U |
| Nov. 5, 2013 | (CN) | 2013 1 0539999 |
| Nov. 5, 2013 | (CN) | 2013 2 0691285 U |

(51) Int. Cl.
*A45D 2/36* (2006.01)
*A45D 1/10* (2006.01)

(52) U.S. Cl.
CPC ... *A45D 2/36* (2013.01); *A45D 1/10* (2013.01)

(58) Field of Classification Search
CPC ..... A01K 13/002; A45D 24/007; A45D 6/02; A45D 6/04; A45D 2/36
USPC ..... 132/119.1, 206, 207, 212, 237–243, 132/252
See application file for complete search history.

(56) References Cited

U.S. PATENT DOCUMENTS 1,806,711 A 5/1931 Salzman
2,008,656 A * 7/1935 Cooper ..... 132/242

(Continued)

FOREIGN PATENT DOCUMENTS

CN 2584022 Y 11/2003
CN 2674925 Y 2/2005

(Continued)

OTHER PUBLICATIONS

Trade Box, LLC, International Search Report and Written Opinion issued in related International Patent Application No. PCT/US2014/042414 filed Jun. 13, 2014; International Searching Authority/USPTO, Nov. 4, 2014.

(Continued)

*Primary Examiner* — Rachel Steitz
*Assistant Examiner* — Jennifer Gill
(74) *Attorney, Agent, or Firm* — Laura M. Lloyd; Katherine B. Sales; Leech Tischman Fuscaldo & Lampl

(57) ABSTRACT

A hair styling device is described that has a handle, an elongated, substantially cylindrical, heatable rod providing a curling surface and supported by the handle, a heater for heating the curling surface, a support spaced apart from the curling surface, and a rotatable member rotatable relative to the curling surface for wrapping hair around and in contact with the curling surface. The device has an opening in the rotatable member for receiving a section of a user's hair, a motor for rotating the rotatable member, and a flexible, heat-resistant clamp supported by the support and extending from the support toward the curling surface for clamping hair against the curling surface.

11 Claims, 14 Drawing Sheets

(56) References Cited

U.S. PATENT DOCUMENTS

| | | | | | |
|---|---|---|---|---|---|
| 2,075,652 | A | * | 3/1937 | Leland | 132/238 |
| 2,593,544 | A | * | 4/1952 | Davis et al. | 132/237 |
| 2,867,223 | A | | 1/1959 | Anzalone | |
| 2,935,070 | A | | 5/1960 | Auz | |
| 3,213,860 | A | | 10/1965 | Mizell et al. | |
| 3,363,634 | A | | 1/1968 | Leclabart | |
| 3,442,271 | A | | 5/1969 | D'Angio | |
| 3,618,620 | A | | 11/1971 | Williams | |
| 3,835,292 | A | | 9/1974 | Walter et al. | |
| 4,148,330 | A | * | 4/1979 | Gnaga | 132/238 |
| 4,177,824 | A | * | 12/1979 | Gnaga | 132/238 |
| 4,222,398 | A | | 9/1980 | Fromman | |
| 4,233,999 | A | | 11/1980 | Thomas | |
| 4,243,061 | A | | 1/1981 | Buchanan | |
| 4,358,660 | A | | 11/1982 | Andis | |
| 4,368,376 | A | | 1/1983 | Andis | |
| 4,743,735 | A | | 5/1988 | Abura et al. | |
| 4,829,156 | A | | 5/1989 | Thompson | |
| 5,119,847 | A | | 6/1992 | Powell et al. | |
| 5,513,665 | A | | 5/1996 | Chan | |
| 5,671,759 | A | | 9/1997 | Chung et al. | |
| 5,725,000 | A | | 3/1998 | Rice | |
| 5,868,146 | A | | 2/1999 | Henninger et al. | |
| 6,450,176 | B1 | | 9/2002 | Yokokawa | |
| 6,637,441 | B2 | | 10/2003 | Kennedy et al. | |
| 6,668,840 | B1 | | 12/2003 | Mugge et al. | |
| D491,310 | S | | 6/2004 | Glucksman et al. | |
| D502,288 | S | | 2/2005 | Longoria | |
| D502,568 | S | | 3/2005 | Longoria | |
| D515,738 | S | | 2/2006 | Grassi | |
| 7,124,763 | B2 | | 10/2006 | Hafemann | |
| 7,513,259 | B2 | | 4/2009 | Kimata et al. | |
| 7,971,593 | B2 | | 7/2011 | Bartels | |
| 8,132,571 | B1 | | 3/2012 | Jackson | |
| D696,456 | S | | 12/2013 | Julemont | |
| 8,607,804 | B2 | | 12/2013 | De Benedictis | |
| 8,646,465 | B2 | | 2/2014 | Tam | |
| 8,651,118 | B2 | | 2/2014 | De Benedictis et al. | |
| 8,733,374 | B2 | | 5/2014 | De Benedictis et al. | |
| 2004/0237991 | A1 | * | 12/2004 | Glucksman et al. | 132/271 |
| 2005/0241663 | A1 | | 11/2005 | Getahun | |
| 2006/0191888 | A1 | | 8/2006 | Carlucci | |
| 2006/0237418 | A1 | | 10/2006 | Bousfield et al. | |
| 2007/0215170 | A1 | | 9/2007 | Kennedy et al. | |
| 2008/0035167 | A1 | | 2/2008 | Chan | |
| 2008/0216860 | A1 | | 9/2008 | Legrain | |
| 2008/0236610 | A1 | | 10/2008 | Bartels | |
| 2010/0083978 | A1 | | 4/2010 | Hottenrott et al. | |
| 2010/0163071 | A1 | * | 7/2010 | Everett et al. | 132/223 |
| 2010/0170883 | A1 | | 7/2010 | Legrain et al. | |
| 2010/0263684 | A1 | * | 10/2010 | De Benedictis | 132/272 |
| 2011/0017225 | A1 | | 1/2011 | Devulapalli | |
| 2013/0025621 | A1 | | 1/2013 | De Benedictis | |
| 2013/0068245 | A1 | * | 3/2013 | De Benedictis et al. | 132/237 |
| 2013/0098388 | A1 | | 4/2013 | Ragosta et al. | |
| 2014/0007898 | A1 | | 1/2014 | Deng | |
| 2014/0076349 | A1 | | 3/2014 | Deng | |

FOREIGN PATENT DOCUMENTS

| | | | |
|---|---|---|---|
| CN | 1200631 | C | 5/2005 |
| CN | WO2005/082198 | A1 | 9/2005 |
| CN | 1921782 | A | 2/2007 |
| CN | 200980417 | Y | 11/2007 |
| CN | 103099419 | A | 5/2013 |
| CN | 203341177 | U | 12/2013 |
| CN | 203563816 | U | 4/2014 |
| CN | 203814825 | U | 9/2014 |
| DE | 19527111 | A1 | 1/1997 |
| EP | WO2005/096873 | A1 | 10/2005 |
| EP | 2081464 | | 7/2009 |
| FR | 38041 | A | 3/1931 |
| FR | 641097 | A | 3/1931 |
| FR | 1318776 | A | 1/1963 |
| FR | WO2008/132345 | A2 | 11/2008 |
| FR | 2923684 | A | 5/2009 |
| GB | 198103 | A | 5/1923 |
| GB | 302952 | A | 12/1928 |
| GB | 389523 | A | 3/1933 |
| GB | 403704 | A | 12/1933 |
| GB | 989130 | A | 4/1965 |
| GB | 1036583 | A | 7/1966 |
| GB | 1157814 | A | 7/1969 |
| GB | 2383949 | A | 7/2003 |
| GB | 2394656 | A | 5/2004 |
| GB | 2413492 | A | 11/2005 |
| GB | WO2008/047120 | A1 | 4/2008 |
| GB | WO2009/077747 | A2 | 6/2009 |
| GB | WO2012/080751 | A2 | 6/2012 |
| JP | S48-85886 | U | 10/1973 |
| JP | S48-90877 | U | 11/1973 |
| JP | S48-92186 | U | 11/1973 |
| JP | S50-10934 | Y | 4/1975 |
| JP | 61010102 | A | 6/1985 |
| JP | S61-10102 | U | 1/1986 |
| JP | 2002-165628 | U | 11/2002 |
| JP | 2007532159 | A | 11/2007 |
| WO | WO88/08240 | A1 | 10/1988 |
| WO | 97/11621 | A1 | 4/1997 |
| WO | WO97/11621 | A1 | 4/1997 |
| WO | WO98/27844 | A1 | 7/1998 |

OTHER PUBLICATIONS

Trade Box, LLC, Design U.S. Appl. No. 29/491,250 for "Hair Curler" filed May 19, 2014.

Trade Box, LLC, Design U.S. Appl. No. 29/509,771 for "Automatic Hair Styling Device" filed Nov. 20, 2014.

Trade Box, LLC, United Design U.S. Appl. No. 29/508,138 for "Automatic Hair Styling Device" filed Nov. 3, 2014.

Internet papers: https://www.youtube.com/watch?v=yqfN1wAbsrl_Demo of the New Nano-Titanium Mira-Curl Iron from Babyliss, Oct. 4, 2014.

Internet papers: http://www.stylebell.com/babyliss-miracurl-nano-titanium-curl-machine-p/sb-02271.htm?gclid=CjwKEAjwnNqgBRDdgOitrZPj6yYSJACM86tD21aLIU9T_Babyliss MiraCurl Nano Titanium Curl Machine & Curling Iron/Model BABNTMC1, Oct. 4, 2014.

Internet papers: http://infiniti.conair.com/catalog.php?pcID=49&products_id=244_Infiniti Pro by Conair Curl Secret, Oct. 4, 2014.

Screen shot of Web page for Babyliss MiraCurl Nano Titanium Curl Machine BABNTMC1; Oct. 4, 2014.

Screen shot of Web page for http://infiniti.conair.com/catalog.php?pcID=49&products_id=244; Oct. 4, 2014.

Screen shot of YouTube video, https://www.youtube.com/watch?v=yqfN1wAbsrl; Oct. 4, 2014.

* cited by examiner

AUTOMATIC HAIR STYLING DEVICE

CROSS-REFERENCE TO RELATED APPLICATIONS

This application claims the benefit of U.S. Provisional Application No. 61/835,390, filed on Jun. 14, 2013, in the United States Patent and Trademark Office, Chinese application number 201320675439.5, filed Oct. 30, 2013, Chinese application number 2013206912859, filed Nov. 5, 2013, Chinese application number 201310539999.2, filed Nov. 5, 2013, and Chinese application number 201310523311.1 filed Oct. 30, 2013. This application is also related to PCT Application No. PCT/US14/42414, filed Jun. 13, 2014, titled "AUTOMATIC HAIR STYLING DEVICE" (SMA Reference Number 50518PCT).

BACKGROUND

Many people have the desire for curled or styled hair. Most people manually style their hair with devices such as curling irons and flat irons, which takes some knowledge of hair styling in order to produce desirable hair styles. Automatic hair styling devices are available, but some can be difficult to use and can result in hair tangling and imperfectly curled or styled hair.

The present invention overcomes the limitation of the prior art by providing an automatic hair styling device designed to produce consistent curls and styles without extensive knowledge or effort from the user with reduced likelihood of tangling.

SUMMARY

This invention is directed to a hair styling device that automatically styles a user's hair with very little effort or knowledge required on the part of the user. In one embodiment, the device comprises a handle, an elongated, substantially cylindrical, heatable rod that provides a curling surface and is supported by the handle, a heater for heating the curling surface, a rotatable member rotatable relative to the curling surface for wrapping hair around and in contact with the curling surface of the rod, an opening in the rotatable member for receiving a user's hair, and a motor for rotating the rotatable member.

In one version, there is a support spaced apart from the curling surface of the rod. The device can also comprise two or more supports.

In one version, there are one or more flexible, heat-resistant first clamps supported by the support and extending from the support toward the curling surface for clamping hair against the curling surface of the rod. The distance between the portion of the clamp closest to the curling surface and the curling surface can be from about 0.1 mm to about 3 mm. The clamp can have a first cross sectional area proximate to the curling surface and a second cross sectional area at the support, where the first cross sectional area is less that the second cross sectional area. The clamp can be proximate to the curling surface and can be triangular in lateral cross section. The clamp can be made of an elastomeric material, such as silicone. The clamp is advantageous in that it helps to smooth and polish the user's hair.

In another version, instead of or in addition to the first clamps, one or more second clamps are supported by the rotatable member.

Preferably, the device does not have a housing around any portion of the curling surface of the rod. The lack of a housing is advantageous because the curling surface is accessible and visible to the user 360 degrees around the rod.

The device can also comprise a hook flanking the opening in the rotatable member for engaging the user's hair. The hook can be made from an elastomeric material such as silicone. Optionally, the hook can have finger-like projections formed from the elastomeric material.

There can be a magnet on the rotatable member, a magnet sensor sensing the magnet, and a controller for positioning the opening in the rotatable member in response to the magnet sensor for receiving a user's hair when the rotation of the rotatable member ceases rotation.

A timer can be used to track the amount of time the hair is placed against the curling surface, and sounds an alarm when the hair should be released from the device. The device can further comprise an optical sensor for detecting when hair has been removed from the curling surface. When the hair is removed from the rod, the timer resets to a starting position.

The device can also comprise a flexible, heat-resistant restrainer arm supported by the restrainer arm support which can be one of the clamp support arms. The restrainer arm extends from the restrainer arm support toward the rod. The restrainer arm is advantageous in that it prevents the hair from twisting as it wraps around the rod. The restrainer arm can have a first cross sectional area proximate to the curling surface and a second cross sectional area at the restrainer arm support, the first cross sectional area being less that the second cross sectional area. The restrainer arm can be constrained proximate to the rod and can be triangular in lateral cross section. Optionally, the restrainer arm can move away from the rod in order to release hair from the device. The restrainer arm can be made of elastomeric material, such as, for example, silicone.

The invention also provides methods for using the hair styling devices described above. The device can be used by placing a selected portion of hair through the opening in the rotatable member, and activating the rotatable member so that the rotatable member winds the selected portion of hair around the curling surface of the rod. The hair is smoothed and polished by the clamp during styling. Once curling of the hair is complete, the user pulls the device away from the hair, thereby releasing the hair from the device.

DRAWINGS

These and other features, aspects, and advantages of the present invention will become better understood with regard to the following description, appended claims, and accompanying drawings.

DESCRIPTION

Figure 1:
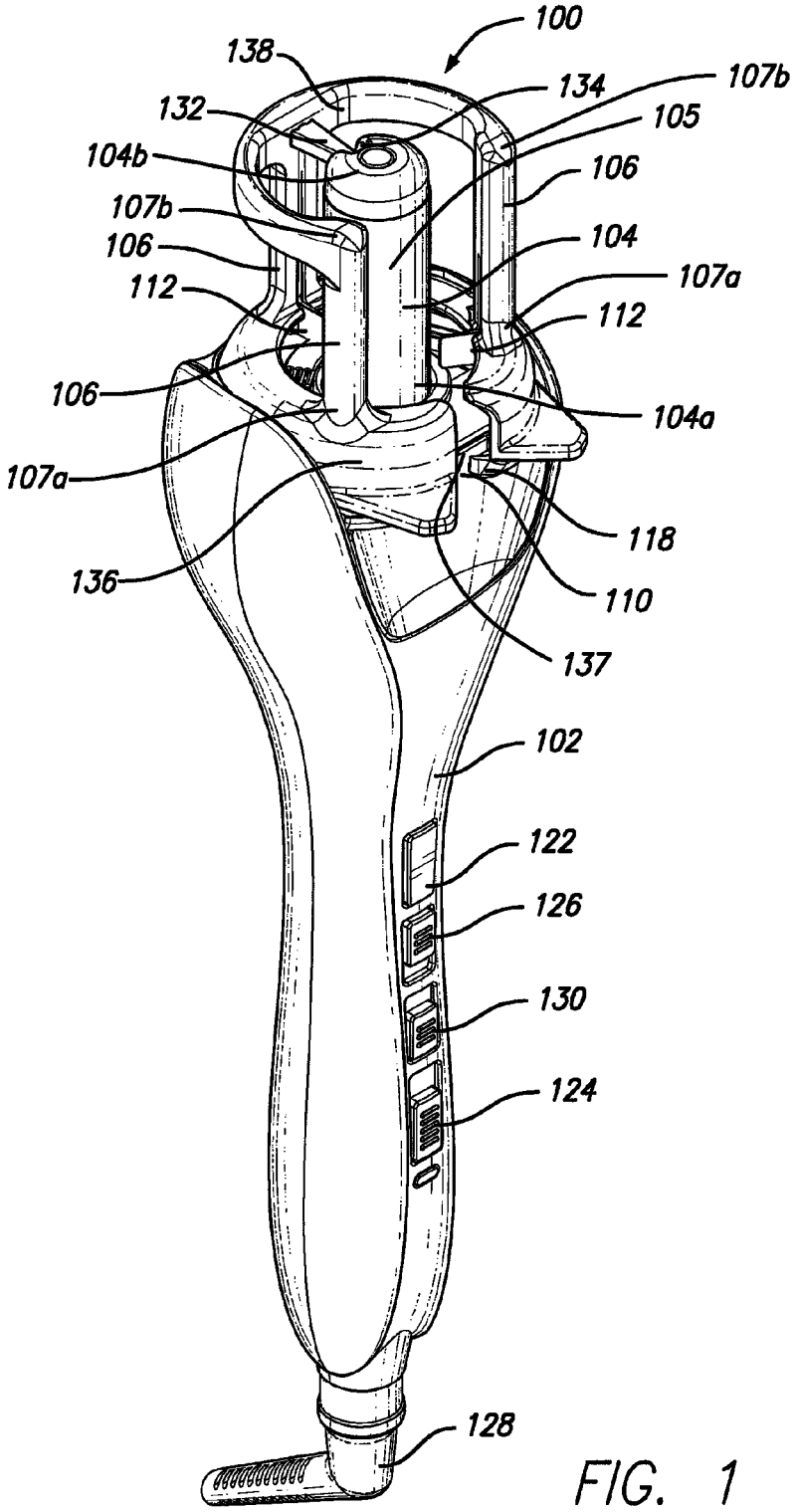
FIG. 1 is a perspective view of an automatic hair styling device having features of the present invention.
Figure 2:
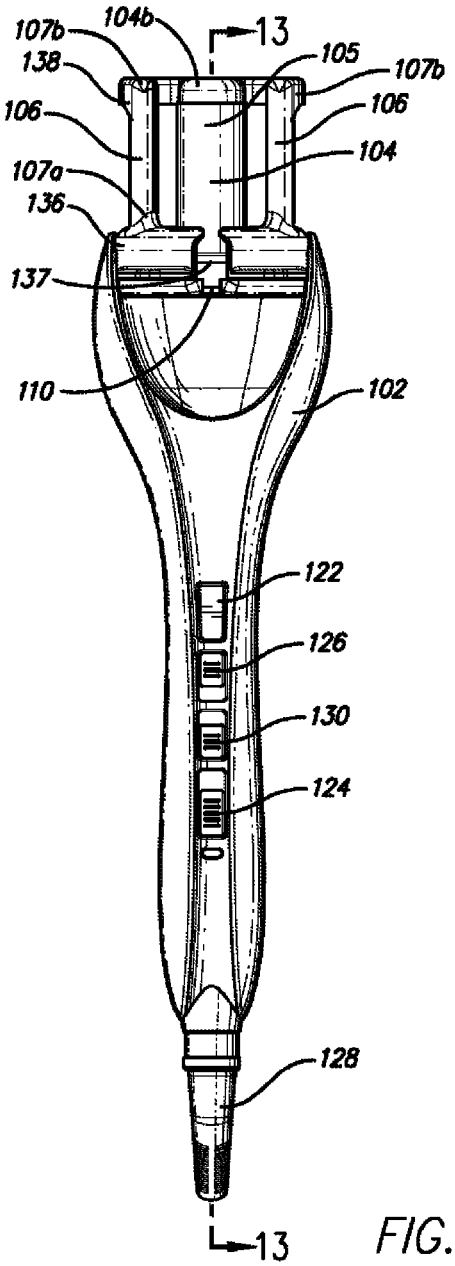
FIG. 2 is a front plan view of the device of FIG. 1.
Figure 3:
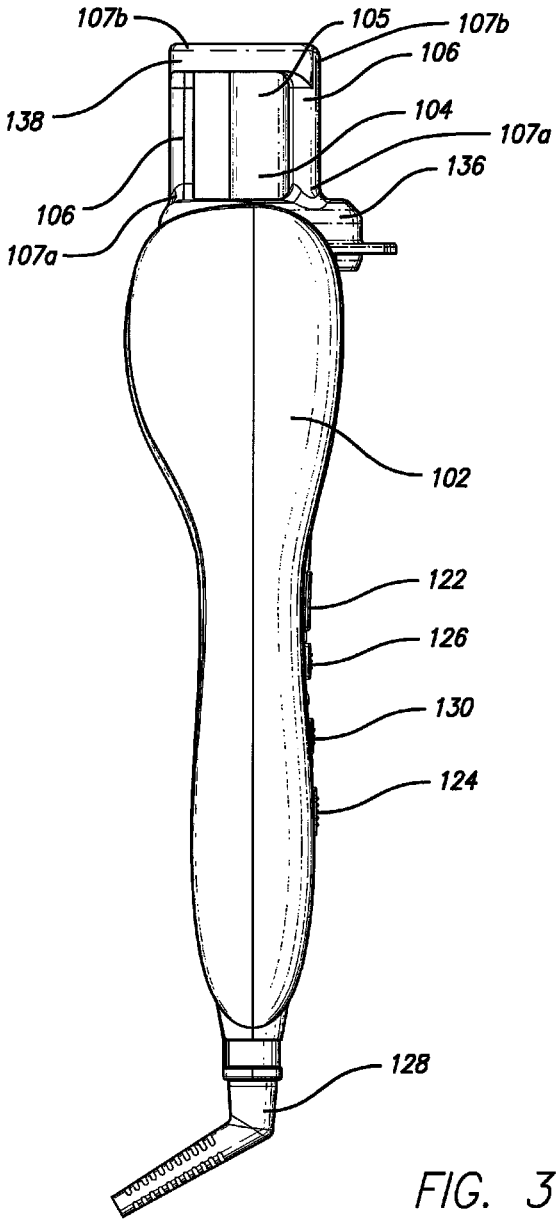
FIG. 3 is a side elevation view of the device of FIG. 1.
Figure 4:
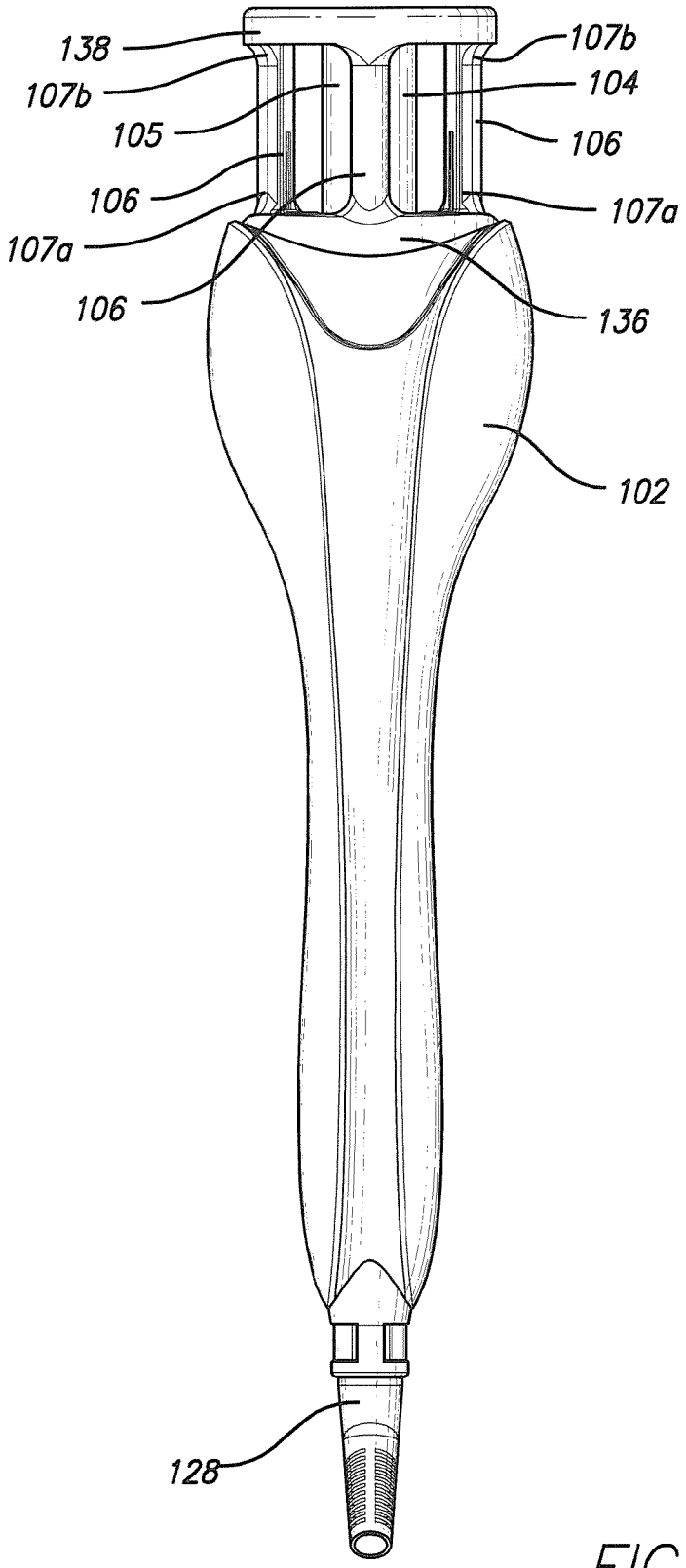
FIG. 4 is a rear elevation view of the device of FIG. 1.

As used herein, the following terms and variations thereof have the meanings given below, unless a different meaning is clearly intended by the context in which such term is used.

The terms "a," "an," and "the" and similar referents used herein are to be construed to cover both the singular and the plural unless their usage in context indicates otherwise.

As used in this disclosure, the term "comprise" and variations of the term, such as "comprising" and "comprises," are not intended to exclude other additives, components, integers ingredients or steps.

The term "cylindrical" means having the form of a cylinder.

The term "hook" means a curved, bent, or angular object. A hook can be used to catch pull, hold, or suspend.

The term "elastomeric" means any material that can bend when a stress, such as pressure, is applied, and returns to its substantially original configuration when the stress is removed.

All dimensions specified in this disclosure are by way of example only and are not intended to be limiting. Further, the proportions shown in these Figures are not necessarily to scale. As will be understood by those with skill in the art with reference to this disclosure, the actual dimensions and proportions of any system, any device or part of a device disclosed in this disclosure will be determined by its intended use.

This invention is directed to a hair styling device 100 for automatically styling a user's hair, such as by curling. As shown in FIGS. 1-6, the device 100 comprises a handle 102 for the user to hold, and an elongated, substantially cylindrical, heatable rod 104 supported by the handle 102. The rod 104 is substantially cylindrical in vertical cross section, and has a proximal end 104*a* and a distal end 104*b*. The proximal end 104*a* of the rod 104 is located near the handle 102, and the distal end 104*b* of the rod 104 is located opposite the handle 102. The rod 104 can be aligned with the handle 102.

The rod 104 provides a curling surface 105 on which the user's hair is wrapped around and styled. The rod 104 and curling surface 105 can be made of any type of material that is able to be heated and is heat conductive, such as, for example, metal or ceramic. The curling surface 105 can be different material then the remainder of the rod 104. The device 100 does not have an enclosed housing around any portion of the curling surface 105. Thus, the curling surface 105 can be visible, and accessible, 360 degrees around the rod 104. This is advantageous because the device requires less material than if it had an enclosed housing, so that manufacturing costs of the device is reduced. The device 100 also weighs less without a housing, so that the user's arm is less likely to tire from holding the device 100. Another advantage is that the user can view the hair as it is wrapped around the rod 104. Yet another advantage is that since there is no housing, the outside of the device 100 is not heated, which provides a cost savings in manufacturing since heaters are not needed. Furthermore, a user can grasp the outside of the heated device 100 without injury. Additionally, the heated device 100 can be placed directly on a surface such as a counter without fear of the device burning the counter.

Figure 13:
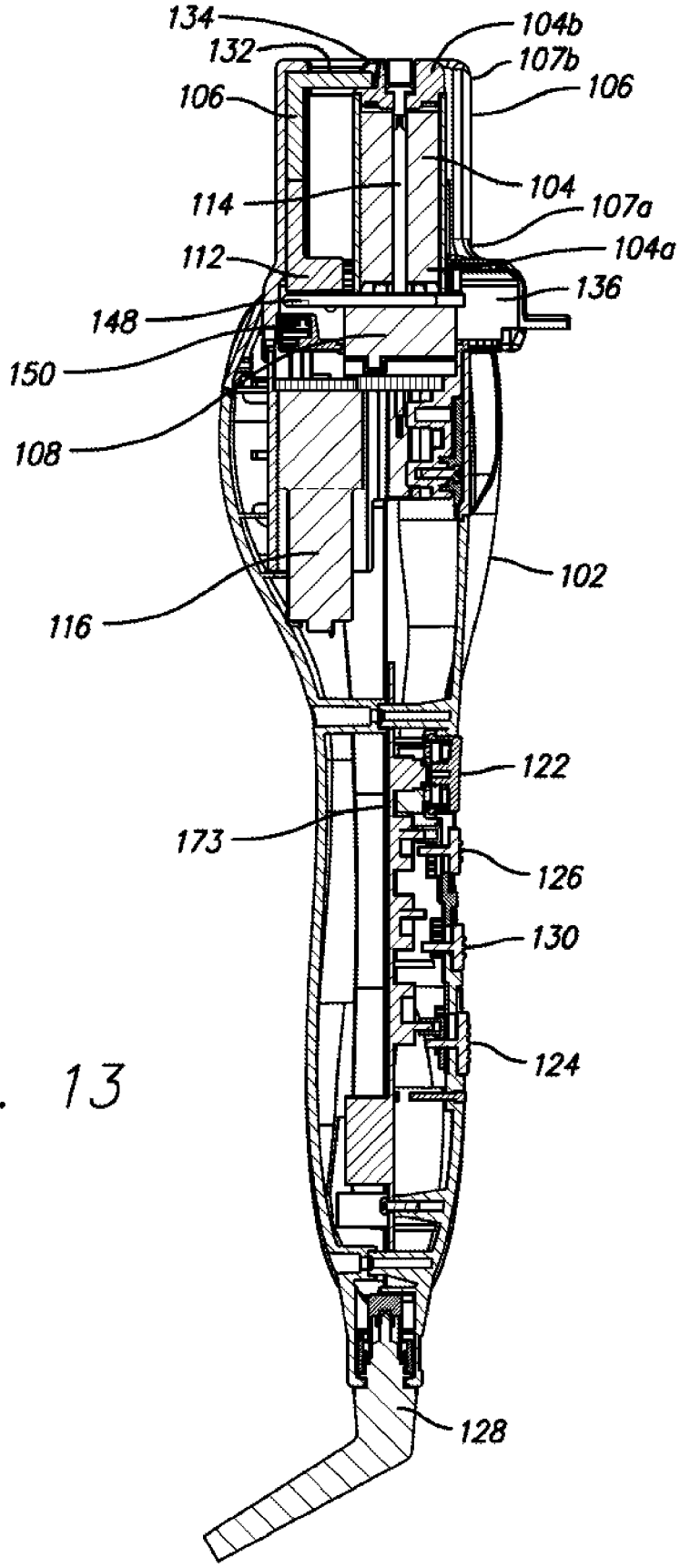
FIG. 13 is a cross sectional view of the device of FIG. 1, taken along line 13-13 of FIG. 2.

The device 100 comprises a handle 102. There is a heater 114 for heating the rod 104 and curling surface 105, as shown in FIG. 13. There is also a motor 116 located in the handle. The handle 102 can have a multi-position, multi-function on/off switch 124, shown in FIGS. 1 to 3, which allows the user to turn the device 100 on and off. The multi-position, multi-function on/off switch 124 can also provide a temperature controller function. This allows the user to select different temperatures depending on hair type and the desired hair style by controlling the amount of electrical current fed to the heater 114. Additionally, both the heater 114 and the motor 116 can be coupled to an electrical cord 128, which allows the device 100 to connect to an electricity source in order to draw the electricity necessary to operate.

Figure 7:
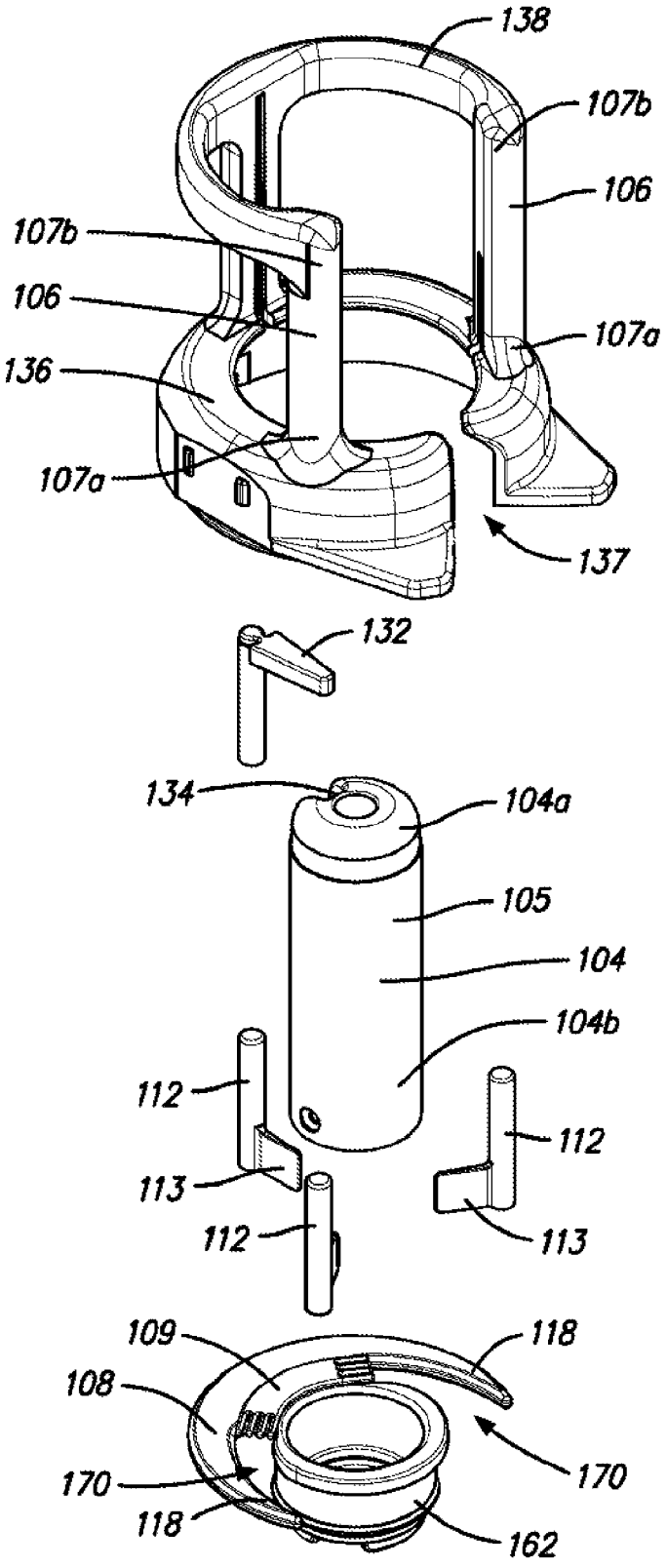
FIG. 7 is an exploded perspective view of the device of FIG. 1.
Figure 14:
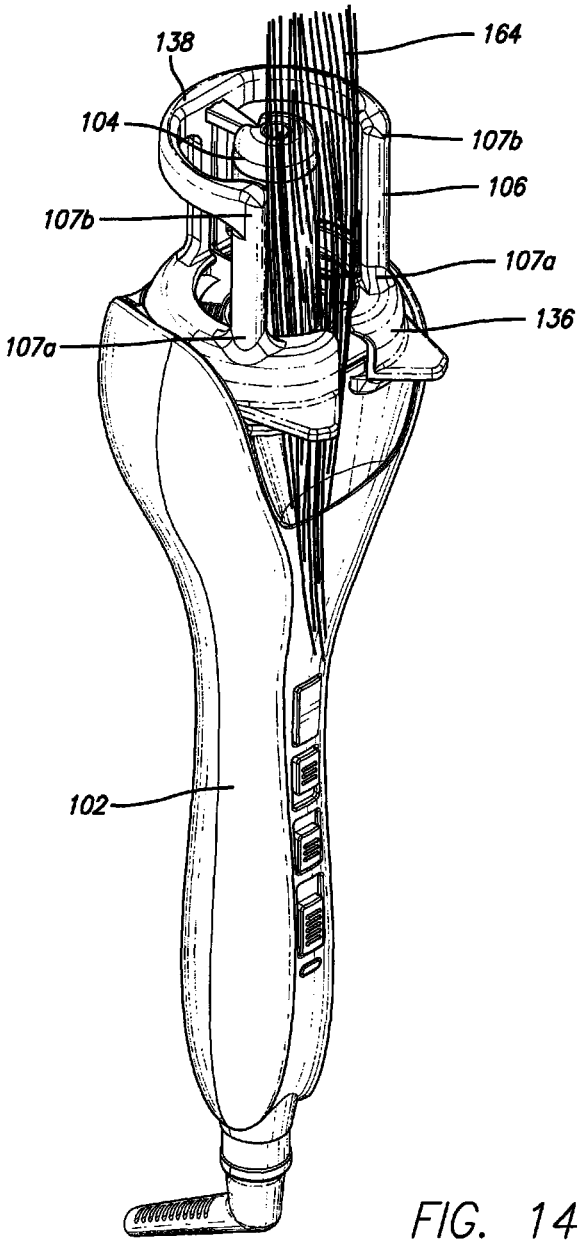
FIG. 14 is a perspective view of the device of FIG. 1 with the user's hair.

The device 100 also comprises a rotatable member 108 located near the proximal end 104*a* of the rod 104. The rotatable member 108 also has a hub 162 so that the rod 104 can be positioned on it, as shown in FIGS. 7 to 11. The rotatable member 108 wraps the user's hair around the rod 104 so that the hair is in contact with the curling surface 105. As shown in FIG. 7, the rotatable member 108 comprises two rotatable member openings 170 for receiving the user's hair when rotated in either direction. The device 100 comprises a motor 116 for rotating the rotatable member 108, as shown in FIG. 14. The motor 116 can be supported by the handle 102.

In use, the rotatable member 108 can be rotated 360 degrees by the motor 116 in either a clockwise or counterclockwise direction. The handle 102 can comprise a rotation direction selection switch 126, shown in FIGS. 1 to 3, which allows the user to select the direction for the rotatable member 108 to rotate.

The handle 102 contains opening 110 which allows for placement of a section of hair 164 into the device 100. The section of hair 164 typically contains enough strands of hair that the hair can be placed in the opening 110, but not too many strands of hair so that the section of hair 164 is too large to fit inside the opening 110.

Figure 11:
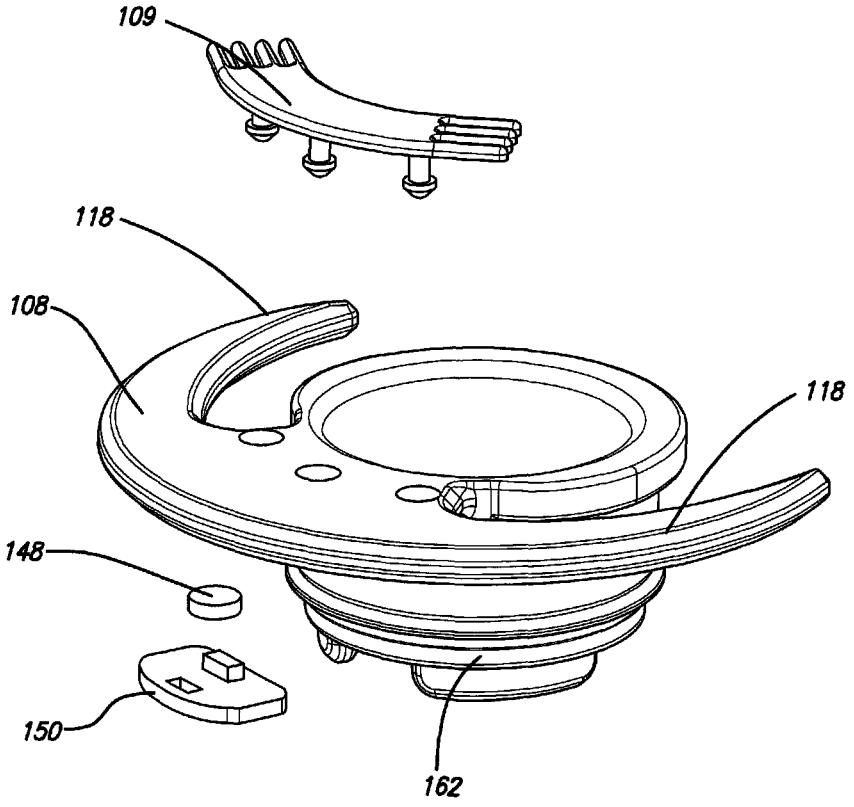
FIG. 11 is an exploded view of the hook, elastomer material, magnet and magnet sensor of the device of FIG. 1.
Figure 12:
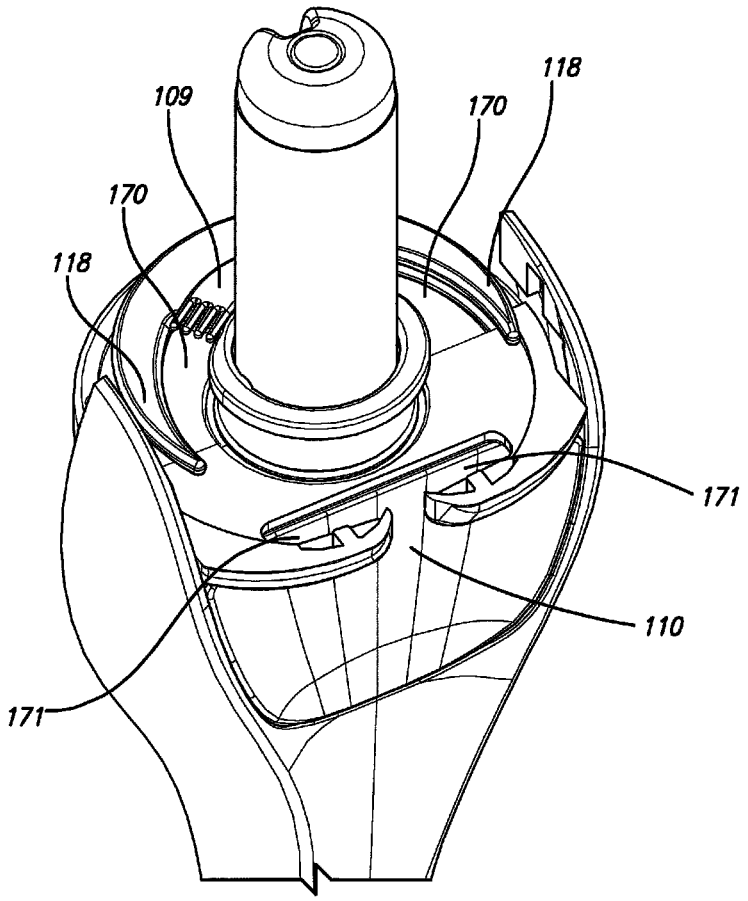
FIG. 12 is a perspective view of portions of the device of FIG. 1 with the supports removed.

The rotatable member opening 170 can form a hook 118, flanking the opening 110 for engaging the user's hair. The hook 118 can also have material for gripping and retaining the user's hair in the rotatable member opening 170. For example, an elastomeric material 109 can be positioned in the nook of the hook 118 as shown in FIGS. 7, 11, and 12. The elastomeric material 109 can be, for example, silicone, thermoplastic polyurethane elastomeric rubber, thermoplastic rubber, polypropylene, or combinations thereof. The elastomeric material 109 can be formed into ribbed or finger-like projections in order to better grip and retain the user's hair so that it can be positioned against the curling surface 105. The elastomeric material 109 provides enough friction to keep tension on the hair while it is being wound around the rod 104 such that tight curls are consistently formed, but not too much friction so that hair is damaged or the motor 116 is strained. The elastomer ribs or fingers are also flexible such that they move and flex with the hair and will not damage the hair. The elastomeric material 109 also functions to provide a more uniform wrap of the hair around the rod 104 to facilitate consistent, rapid transfer of heat from the curling surface 105 to the hair in a minimal amount of time. Additionally, the elastomeric material 109 functions to polish and add shine to the user's hair.

The purpose the rotatable member opening 170, and in particular the hook 118, is to capture the hair and aid in guiding the hair as it is wound around the rod 104.

Figure 10:
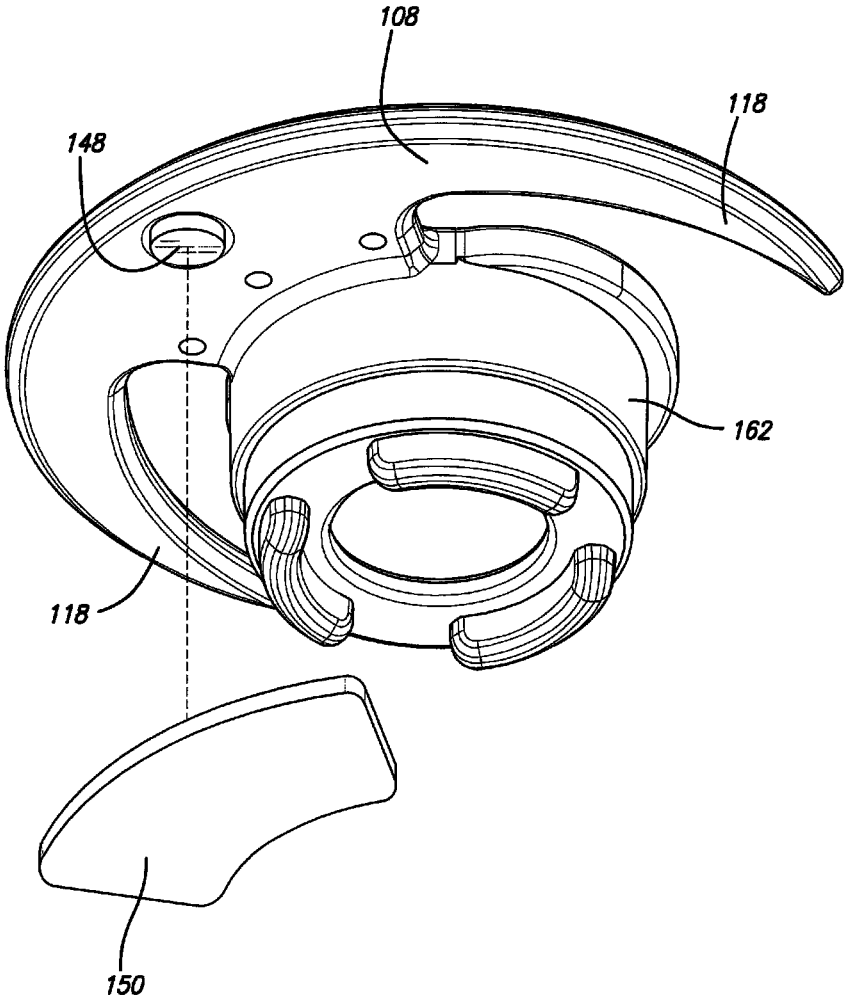
FIG. 10 is an exploded view of the rotatable member, magnet and magnet sensor of the device of FIG. 1.

As shown in FIGS. 10 and 11, the device 100 can have a magnet sensing system comprising a magnet 148 and magnet sensor 150 for automatically positioning the rotatable member opening 170, as shown in FIGS. 10 and 11. After a section of the user's hair is curled, the magnet 148 and magnet sensor 150 are aligned by a controller 173 so that the rotatable member opening 170 is aligned with housing opening 110 and a lower support element opening 137 in a lower support element 136. The device is then ready to receive the next section of a user's hair. The magnet 148 can be located on the rotatable member 108, and the magnet sensor 150 can be located in the handle 102 of the device. The magnet sensor 150 determines the location of the magnet 148, and allows the rotatable member 108 to be positioned to align the rotatable member opening 170 with housing opening 110 and the lower support element opening 137. The automatic positioning of the rotatable member opening 170 allows the user to quickly insert the next section of hair 164 into the device after the previous section of hair 164 has been curled. The alignment of the rotatable member opening 170 with housing opening 110 and the lower support element opening 137 is also desirable for ease of use because it provides a larger opening for placement of the section of hair 164 by the user.

In one embodiment, the device 100 can have at least one support 106 that is spaced apart from the rod 104. The device can also comprise two or more supports 106. The supports 106 extend parallel to the rod 104 and has a proximal end 107*a* supported by the lower support element 136 and a distal end 107*b* supported by an upper support element 138. FIGS. 1, 4, 5, and 7 depict a configuration of the device 100 with three supports 106, which are evenly spaced apart from each other.

In one embodiment, the device 100 comprises a flexible, heat-resistant first clamp 112. In one embodiment, the first clamp 112 extends from the support 106 near the lower support element 136, as shown in FIGS. 1 and 7. While it is contemplated that each support 106 contains a first clamp 112, it is not necessary that each support 106 contains a first clamp 112. The first clamp 112 extends from the support 106 toward the rod 104 to hold the hair tightly against the heated curling surface 105. The first clamp 112 is also designed so that it does not to impede the wrapping of the hair around the rod 104 by the rotatable member 108.

An advantage of the first clamp 112 is that it positions the hair to abut the heated curling surface 105 for the entire styling period. This results in much tighter curls, which are more desirable by the user. The clamping of the hair also facilitates rapid transfer of heat in minimal time, resulting in less damage to the hair. In addition, the clamp helps smooth and polish the user's hair as it passes over the user's hair.

The distance between the clamp and the curling surface 105 can be from about 0.1 mm to about 3 mm. The distance between the first clamp 112 and the curling surface 105 depends on the thickness of the user's hair wrapped around the rod 104. It is contemplated that the first clamp 112 can be a passive clamp, meaning that the clamp has to be engaged by the hair to hold the hair. The end of the first clamp 112 attached to the support 106 is fixed, while the end of the first clamp 112 that is closest to the curling surface 105 moves passively away from the rod as the hair is wrapped around the rod 104. The less hair that is wrapped around the rod, the smaller the distance between the first clamp 112 and the curling surface 105. Conversely, the more hair wrapped around the rod 104, the larger the distance between the first clamp 112 and the curling surface 105.

It is also contemplated that the first clamp 112 can be an active clamp, meaning that it is automatically engaged by a switch or otherwise activated to hold the hair against the curling surface 105.

The first clamp 112 can have a first cross sectional area proximate to the rod 104 and a second cross sectional area at the support 106, the first cross sectional area being less that the second cross sectional area. The first clamp 112 can be triangular in lateral cross section.

The first clamps 112 can be made out of any material that is heat resistant, such as an elastomeric material. The clamp elastomeric material 113 can be, for example, silicone, thermoplastic polyurethane elastomeric rubber, thermoplastic rubber, and polypropylene.

Figure 8:
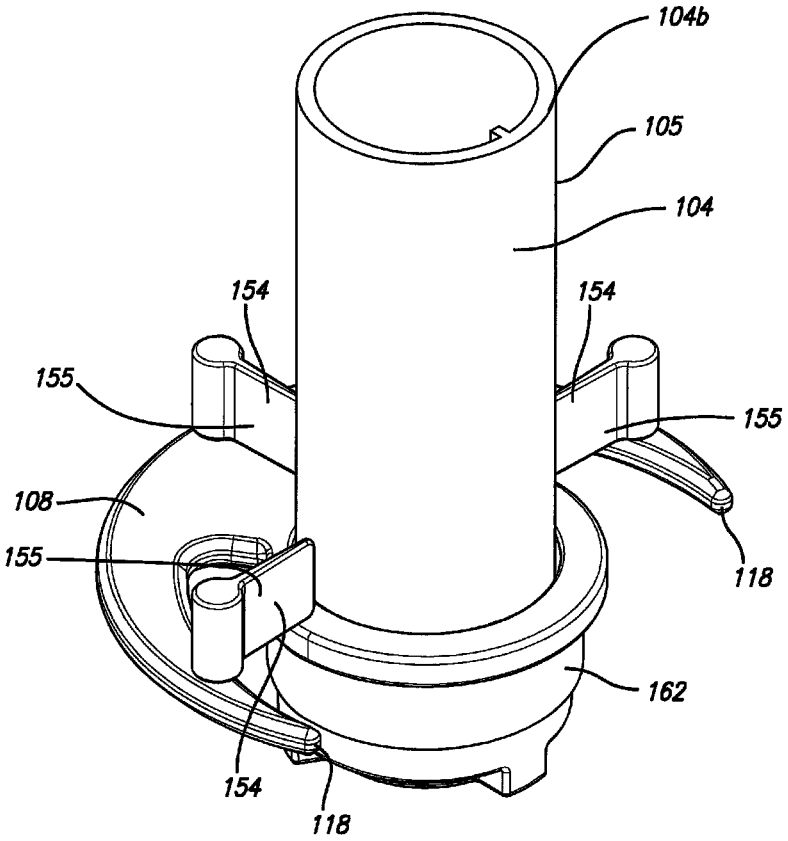
FIG. 8 is a perspective view of an alternate version of the rotatable member of the device.
Figure 9:
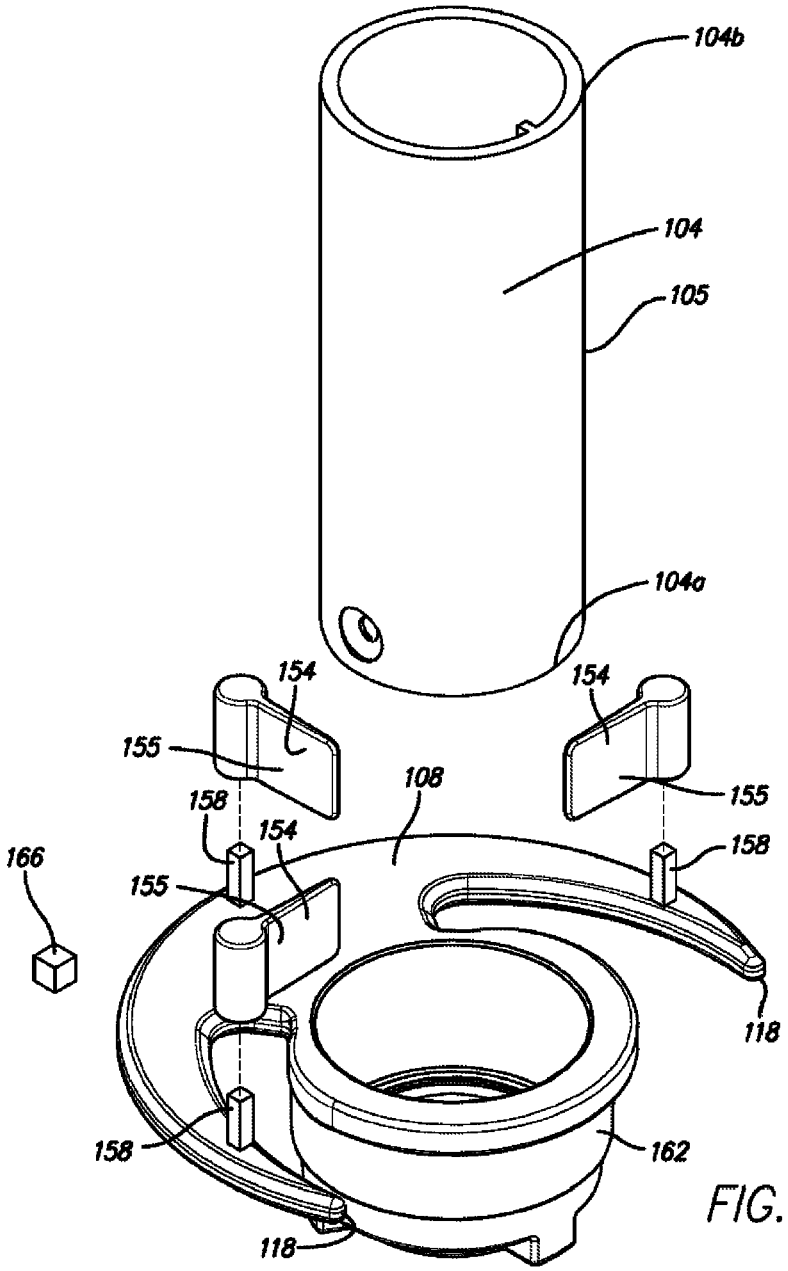
FIG. 9 is an exploded view of the rotatable member of FIG. 8.

In another embodiment, the device can contain one or more second clamps 154 positioned on the rotatable member 108, as shown in FIGS. 8 and 9. The distance between the second clamp 154 and the rod 104 can be from about 0.1 mm to about 3 mm. The alternative clamps 154 are mounted onto the rotatable member 108 so that the alternative clamps 154 can rotate bi-directionally in relation to the curling surface 105. The alternative clamps 154 can be made out of any material that is heat resistant, such as an elastomeric material. The alternative clamp elastomeric material 155 can be, for example, silicone, thermoplastic polyurethane elastomeric rubber, thermoplastic rubber, and polypropylene.

Figure 5:
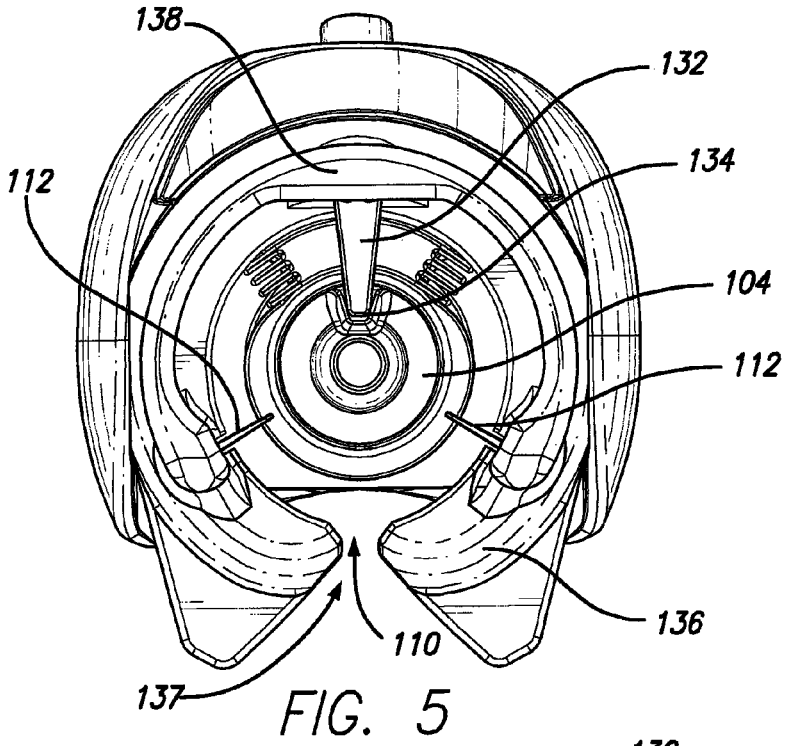
FIG. 5 is a top plan view of the device of FIG. 1.
Figure 6:
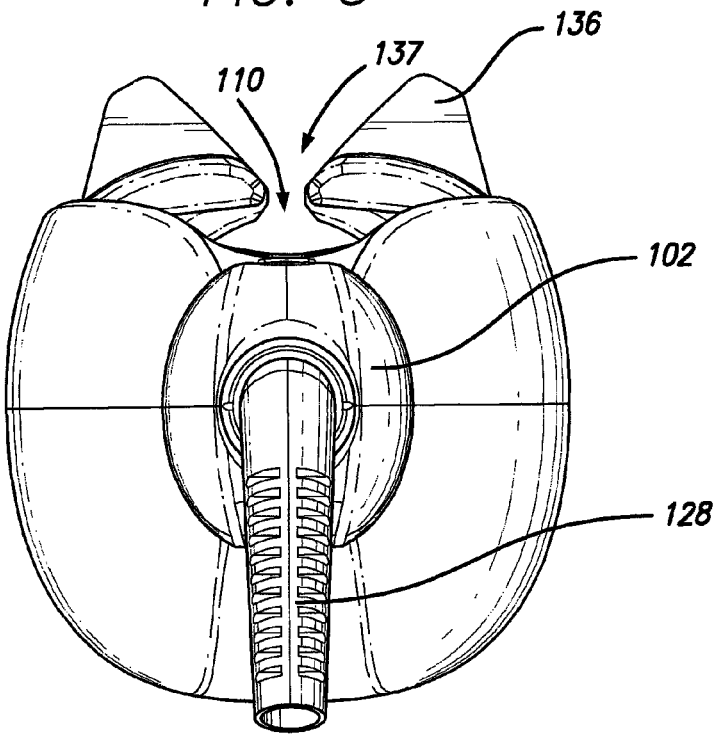
FIG. 6 is a bottom plan view of the device of FIG. 1.

The device can also contain a flexible, heat-resistant restrainer arm 132, as shown in FIGS. 1 and 5. The restrainer arm 132 is supported by the support 106 and extends radially from the support 106 toward the curling surface 105.

The restrainer arm 132 has a first cross sectional area where the arm 132 is proximate to the curling surface 105, and a second cross sectional area where the arm is fixedly attached to the support 106. In one embodiment, the first cross sectional area is less that the second cross sectional area. It is contemplated that the restrainer arm 132 is triangular in lateral cross section. In another embodiment, the restrainer arm 132 is constrained proximate to the curling surface 105 by a notch 134 in the rod 104, as can be seen in FIG. 5. Also as seen in FIG. 5, the restrainer arm 132 is located at a position opposite the housing opening 110. The restrainer arm 132 can move vertically, but is restrained from moving horizontally due to the insertion of the restrainer arm 132 into the notch 134. The vertical movement allows the user's hair to slide off the distal end of the rod 104 after the hair has been styled, while the restriction of horizontal movement allows the restrainer arm 132 to successfully prevent the user's hair from twisting as the hair is wrapped around the rod 104.

The restrainer arm can be made out of any heat resistant, flexible material, such as, for example, an elastomeric material such as, for example, silicone, thermoplastic polyurethane elastomeric rubber, thermoplastic rubber, or polypropylene.

Optionally, the device 100 can have a timer 130, which tracks the amount of time the hair is placed against the curling surface 105, and sounds an alarm when the hair should be released from the device 100. The device 100 can have any number of timer lengths. The user has the ability to select the timer length depending on the type of hair being styled, the amount of hair in the section, and the style of hair the user is seeking to achieve.

The timer alarm can be in the form of a sound, such as a loud beep or a series of beeps, or the notification can be in the form of a visual indicator, such as a flashing light. Alternatively, the notification can be in the form of a vibration of the device 100 which allows a user who cannot see or hear to know when the timer 130 has gone off. Combinations of two or more notifications can also occur. This is advantageous because a sight or hearing impaired user may require different types of notification.

Additionally, the device 100 can also comprise an optical sensor 166. The optical sensor 166 can determine when the user's hair has been removed from the device 100, thus allowing the timer 130 to operate effectively and allowing the rotatable member 108 to return to its starting position with the rotatable member opening 170 aligned with housing opening 110 and the lower support element opening 137.

The operation and use of the device 100 will now be described. The device 100 can be used by first turning the device on using the on/off switch 124 and selecting the desired temperature using the temperature controller slide switch feature of 124. Prior to operation of the device, the rotatable member opening 170 is aligned with housing opening 110 and the lower support element opening 137.

Figure 15:
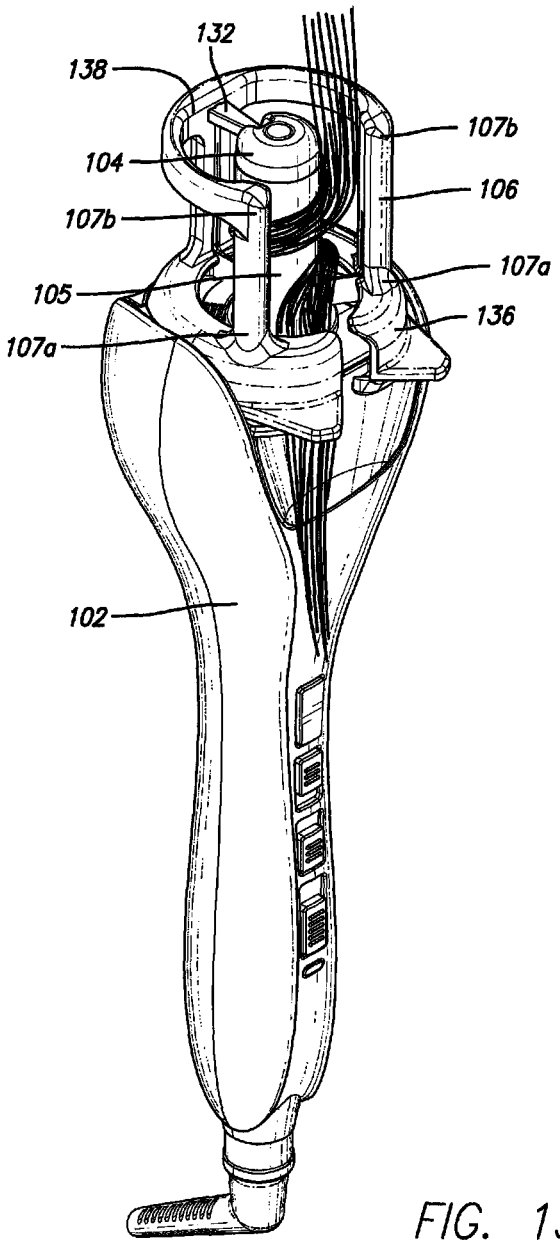
FIG. 15 is a perspective view of the device of FIG. 1 with the user's hair.

As shown in FIG. 14, the user places a section of hair 164 inside housing opening 110 and the lower support element opening 137 into hair retention feature 171. The user selects the desired direction of rotation using the rotation direction selection switch 126. The rotatable member 108 is activated to rotate by the user momentarily pressing the rotation switch 122. The first clamp 112 engages the section of hair 164 after it is wrapped onto the rod 104 by the rotatable member 108. The section of hair 164 continues to be feed through the rotatable member 108 and wraps around the rod 104 until the end of the section of hair 164 passes out of the rotatable member 108. FIG. 15 shows the section of hair 164 wrapped around the rod 104.

Once the entire section of hair 164 has been wound around the rod 104, the rotatable member stops rotating, and the timer 130 begins its countdown. Once the end of the countdown is reached, the device 100 will signal to the user that the time has expired and the section of hair 164 is done curling and ready to be released from the device 100.

Once the hair has been heated to the desired temperature for the requisite amount of time, the user can pull the device 100 away from their head, thereby sliding the section of hair 164 from between the clamp and the curling surface and removing the section of hair 164 from the distal end of the device 100 via the vertical movement of the restrainer arm 132.

Although the present invention has been described in considerable detail with reference to certain preferred embodiments, other embodiments are possible. The steps disclosed for the present methods, for example, are not intended to be limiting nor are they intended to indicate that each step is necessarily essential to the method, but instead are exemplary steps only. Therefore, the scope of the appended claims should not be limited to the description of preferred embodiments contained in this disclosure. All references cited herein are incorporated by reference.

What is claimed is:

1. A hair styling device comprising:

a) a handle;

b) an elongated, substantially cylindrical, heatable rod comprising a curling surface and supported by the handle, the rod having a proximate portion attached proximate to the handle and an opposed distal portion;

c) a heater supported by the handle for heating the curling surface of the rod;

d) a rotatable member supported by the handle and rotatable relative to the curling surface of the rod for wrapping a user's hair around and in contact with the curling surface of the rod;

e) an opening in the rotatable member for receiving the user's hair;

f) a motor housed within the handle for rotating the rotatable member;

g) a rotation direction selection switch on the handle for selecting direction of the rotation of the rotatable member supported by the handle;

h) three supports spaced apart from the curling surface of the rod, wherein the supports extend from the proximate portion of the rod to the distal portion of the rod and are connected together by an upper support element proximate to the distal portion of the rod, wherein there is sufficient spacing between the supports so substantially the entire curling surface of the rod is visible to a user; and i) three flexible, heat-resistant clamps, wherein each clamp comprises a distal portion fixedly and directly attached to one of the supports and a proximate end spaced apart from the rod by about 0.1 to about 3 mm prior to placement of the user's hair in the opening in the rotatable member, wherein the proximate end of each clamp can move bidirectionally and wherein each clamp is configured to clamp the user's hair against the curling surface of the rod that is heatable by the heater.

2. The hair styling device of claim 1, wherein the curling surface of the rod is accessible 360 degrees around the rod.

3. The hair styling device of claim 1 comprising a hook at the opening of the rotatable member for engaging the user's hair.

4. The hair styling device of claim 3, wherein the hook comprises elastomeric material.

5. The hair styling device of claim 3, wherein the hook comprises finger-like projections formed from elastomeric material.

6. The hair styling device of claim 1, wherein the clamps have a first cross sectional area proximate to the curling surface of the rod, and a second cross sectional area at the support, the first cross sectional area being less that the second cross sectional area.

7. The hair styling device of claim 6, wherein the clamps are proximate to the curling surface of the rod and are triangular in lateral cross section.

8. The hair styling device of claim 1 comprising a magnet on the rotatable member, a magnet sensor for positioning the opening of the rotatable member, and a controller for positioning the opening in the rotatable member to a selected position for receiving a user's hair when the rotation of the rotatable member ceases rotation.

9. The hair styling device of claim 1, wherein the clamps are made of elastomeric material.

10. The hair styling device of claim 9, wherein the elastomeric material is silicone.

11. The hair styling device of claim 1, further comprising an optical sensor for detecting when hair has been removed from the curling surface of the rod.

* * * * *